US005904095A

United States Patent [19]

Nelson

[11] Patent Number: 5,904,095

[45] Date of Patent: May 18, 1999

[54] BRIDGE MANDREL FOR FLEXOGRAPHIC PRINTING PRESSES

[75] Inventor: Robert R. Nelson, Green Bay, Wis.

[73] Assignee: MECA of Green Bay, Inc., Green Bay, Wis.

[21] Appl. No.: 08/820,584

[22] Filed: Mar. 19, 1997

[51] Int. Cl.[6] ..... B41F 13/10

[52] U.S. Cl. ..... 101/375; 492/4

[58] Field of Search ..... 101/375, 216; 492/4, 5

[56] References Cited

U.S. PATENT DOCUMENTS

| | | | |
|---|---|---|---|
| 4,089,265 | 5/1978 | White et al. | 101/375 |
| 4,378,622 | 4/1983 | Pinkston et al. | 29/148.4 |
| 4,381,709 | 5/1983 | Katz | 101/375 |
| 4,386,566 | 6/1983 | Moss | 101/375 |
| 4,641,411 | 2/1987 | Meulen | 101/375 |
| 4,651,643 | 3/1987 | Katz et al. | 101/375 |
| 4,685,393 | 8/1987 | Saueressig | 101/375 |
| 4,794,858 | 1/1989 | Katz | 101/375 |
| 4,903,597 | 2/1990 | Hoage et al. | 101/375 |
| 5,206,992 | 5/1993 | Carlson et al. | 29/895.32 |
| 5,216,954 | 6/1993 | Thompson | 101/375 |
| 5,256,459 | 10/1993 | Carlson | 428/36.3 |
| 5,415,612 | 5/1995 | Carlson et al. | 492/56 |
| 5,481,975 | 1/1996 | Schulz | 101/375 |
| 5,537,923 | 7/1996 | Boor et al. | 101/375 |

*Primary Examiner*—Eugene Eickholt

*Attorney, Agent, or Firm*—Brian G. Gilpin; Godfrey & Kahn, S.C.

[57] ABSTRACT

A bridge mandrel for use as part of the rollers used in flexographic printing presses. When used as a part of the printing roller, the bridge mandrel allows the use of inexpensive printing sleeves to which the flexographic printing plates can be attached. When used as part of the inking roller, the bridge mandrel provides a durable and cost effective design. The bridge mandrel is made from a cylinder and two bearing sleeves that mount the cylinder to a standard mandrel. When the bridge mandrel is used as a printing roller, the thin printing sleeve mounts to the cylinder by means of an extension of the conventional compressed air mounting system. The ability to use inexpensive thin printing sleeves greatly reduces the cost and time expenditure normally associated with changing the printing rollers in flexographic printing presses. When used as an inking roller, the surface of the bridge mandrel is coated with a ceramic material that is engraved with microfine cells to provide a durable and cost effective inking roller.

16 Claims, 3 Drawing Sheets

BRIDGE MANDREL FOR FLEXOGRAPHIC PRINTING PRESSES

BACKGROUND OF THE INVENTION

This invention relates generally to rollers used in flexographic printing presses, and in particular to a bridge mandrel used to form part of the roller to allow the use of changeable sleeves in conjunction with printing rollers and to provide more durable and cost effective inking rollers.

In the flexographic printing process, a printing roller rolls a flexographic printing plate, typically made from photopolymer or rubber, over paper held on a central impression drum. The printing plate on the roller is inked by an ink roller having microfine cells saturated with ink. The presses operate at very high speeds, sometimes printing over 600 linear feet of paper per minute, which requires that the rollers rotate at very high rotational speeds. The construction of the printing roller and inking roller can vary and many different constructions have been used to attempt to optimize the printing performance of the rollers. The optimal printing roller would be durable, easy to change by one operator, provide a high quality print, maintain a high degree of concentricity, and have a low cost. The optimal inking roller would be durable, cost effective, provide good ink flow, and maintain a high degree of concentricity.

A frequently attempted method to provide such a printing roller involves the use of several layers of materials having different properties. For example, the printing roller supplied by Windmöller & Hölscher for use with its Soloflex® flexographic press comprises a mandrel having compressed air conduits and an integrated cover sleeve having a microporous foam inner core and a nonporous polymeric outer surface layer. The flexible printing plates are then attached to the nonporous polymeric outer surface layer. The integrated cover sleeve is easily removed from the mandrel by using air pressure passing through the mandrel to expand the diameter of the cover sleeve. The problem with this system is that the integrated cover sleeves are quite expensive and do not last a long time or work very well because they tend to quickly lose their concentricity.

Another attempt to provide a printing roller that is easy to change by one operator, provides a high quality print, and has a low cost, involves the manufacture of the sleeves out of solid urethane. The drawback to this attempt at a solution is that it is very difficult to bore the necessary holes through the solid urethane, and the solid rollers do not maintain their concentricity very well.

Currently available inking rollers, such as those provided by Windmöller & Hölscher for use with its Soloflex® flexographic presses, typically comprise a mandrel having compressed air conduits and an inking sleeve. The inking sleeve is usually a multi-layered construction with an outer layer made from ceramic having microfine cells and a porous foam inner layer. The inking sleeve is changed in virtually the same way as the printing sleeve—using compressed air. The problem with using an inking sleeve such as this is that the sleeves do not last a long time because they quickly loose their concentricity.

This invention relates to an improved roller construction and to solutions to some of the problems raised or not solved by existing roller configurations.

SUMMARY OF THE INVENTION

It is therefore an object of the present invention to provide printing and inking rollers that are durable when used in flexographic printing presses.

It is another object of the present invention to provide printing and inking rollers, for use in flexographic printing presses, which rollers can easily be changed by one operator.

It is a further object of the present invention to provide a printing roller, for use in flexographic printing presses, which roller is sufficiently inexpensive that the printing plates can be left on the sleeve for repeat orders.

It is still another object of the present invention to provide printing and inking rollers that provide a high quality print when used in flexographic printing presses.

It is an additional object of the present invention to provide printing and inking rollers that maintain a high degree of concentricity.

The roller of the present invention provides the above identified and many additional objects by providing a bridge mandrel for use in conjunction with standard mandrels. The bridge mandrel for use as a printing roller additionally comprises a thin, inexpensive printing sleeve. The bridge mandrel for use as an inking roller further comprises a ceramic coating in which microfine cells are engraved.

The bridge mandrel comprises a lightweight steel cylinder that has bearing caps on each end. The bearing caps allow the bridge mandrel to slide over the existing mandrel in the press. The assembled bridge mandrel unit, including both bearing caps and the cylinder, locks into place on the existing mandrel with a lock collar and is caused to rotate by a pin on the existing mandrel that engages one of the bearing caps in a notch formed in the bearing cap. In the printing roller embodiment, the compressed air used to install the standard thick printing roller sleeve passes through the bridge mandrel so that inexpensive thin-walled printing sleeves can slide over the bridge mandrel. The ability to use inexpensive sleeves in the press allows the printing company to leave printing plates mounted to the printing sleeves for repeat print jobs.

Changing the printing roller from a standard integrated cover sleeve to a printing roller in accordance with the present invention is a simple and expedient process. To remove the existing integrated cover sleeve, the press operator turns on the compressed air to expand the sleeve and then removes the sleeve from the mandrel. Then, the operator turns off the air and clamps the bridge mandrel in accordance with the present invention in place on the standard mandrel. After the bridge mandrel is installed, the compressed air is turned on and a new thin sleeve is placed on the bridge mandrel. The entire conversion process can be completed by a skilled operator in as little as four minutes and the flexographic press can then be used with both the standard thick integrated cover sleeves and the thin cover sleeves in accordance with the present invention with minimal machine downtime.

Similarly, changing the inking roller from a standard inking roller sleeve to an inking roller in accordance with the present invention is a simple and expedient process. To remove the existing inking roller sleeve, the press operator turns on the compressed air to expand the sleeve and then removes the sleeve from the mandrel. Then, the operator turns off the air and clamps the bridge mandrel in accordance with the present invention in place on the standard mandrel. Because the bridge mandrel has a coating containing microfine cells, no additional steps are necessary and the installation of the inking roller in accordance with the present invention is complete.

These and other objects and advantages of the present invention will become apparent from the detailed description, claims, and accompanying drawings.

DETAILED DESCRIPTION

Figure 1:
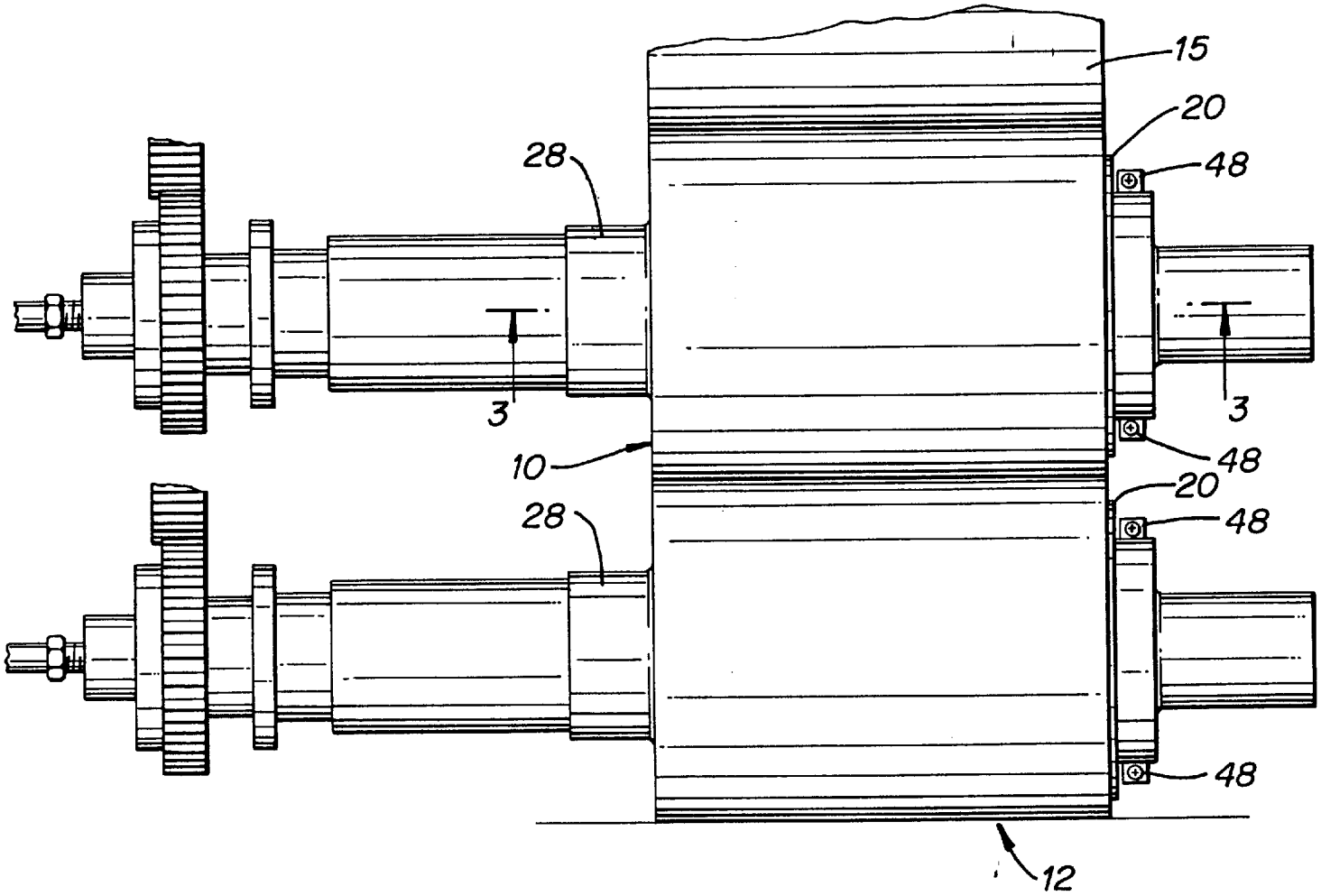
FIG. 1 is a side view of printing and inking rollers having bridge mandrels constructed in accordance with the present invention.

FIG. 1 is a side view of a printing roller 10 and an inking roller 12, each having a respective bridge mandrel 20 constructed in accordance with the present invention. The printing roller 10 is shown in rolling engagement with the central impression drum 15 around which the paper rolls to be printed. The printing roller 10 is also in rolling engagement with the inking roller 12 such that ink is provided to the printing roller 10 by the inking roller 12.

Figure 2:
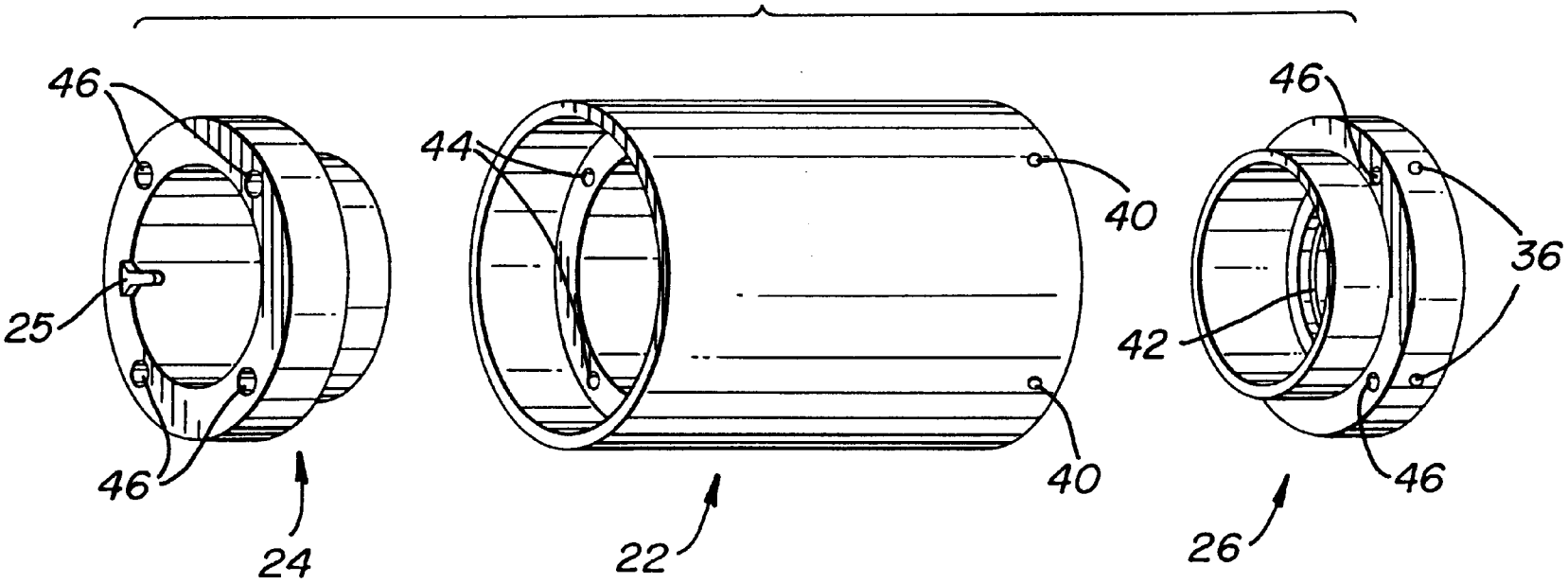
FIG. 2 is a perspective exploded view of the bridge mandrel in accordance with the present invention.
Figure 3:
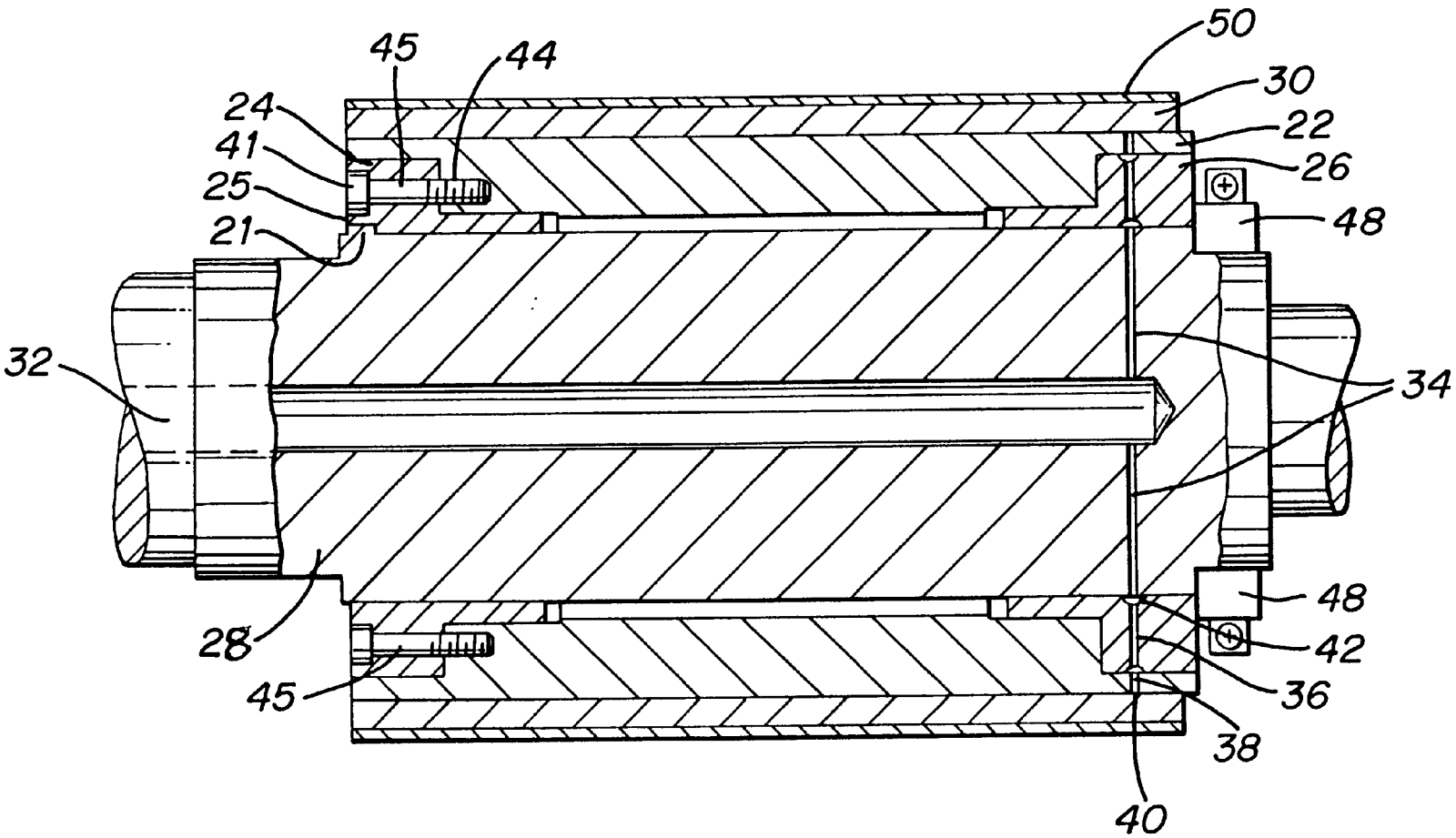
FIG. 3 is side cross-sectional view of the printing roller taken generally along line 3—3 of FIG. 1.

As shown exploded in FIG. 2 and in section in FIG. 3, the bridge mandrel 20 is made from a steel cylinder 22 having first and second composite bearing sleeves 24 and 26 bolted to each end. When assembled, the bridge mandrel 20 slides over an existing, standard sized mandrel 28 in a flexographic printing press. In the printing roller, this enables the use of thin-walled composite printing sleeves 30 with the standard sized mandrel. The existing, standard sized mandrel 28 will hereafter be referred to as the "first mandrel 28," to distinguish it from the bridge mandrel 20.

In existing printing rollers for flexographic printing presses, the first mandrel 28 has an air conduit 32 formed therein. Compressed air is pumped through air conduit 32. This compressed air is released through air vents 34 which extend generally radially outwardly at a predetermined point along the length of the first mandrel 28, generally forming a plane normal to the axis of the mandrel. This compressed air causes the expandable integrated cover sleeve to expand enough to allow it to slide on and off the first mandrel.

As best detailed in FIG. 3, in the present invention, a similar process enables the thin-walled printing sleeve 30 to slide on and off the bridge mandrel 20. The compressed air passes through the first mandrel 28 and out the air vents 34. The compressed air then passes through air passageways 36 formed in the second bearing sleeve 26, through air passageways 38 formed in the cylinder 22, and out air vents 40 formed in the cylinder. In the preferred embodiment of the bridge mandrel 20, there are four cylinder air vents 40 with corresponding second bearing sleeve air passageways 36 and cylinder air passageways 38, each extending generally radially outward. Also in the preferred embodiment, but not essential to achieve the purpose of the invention, the second bearing sleeve 26 has an air circulation conduit 42 so that the second bearing sleeve air passageways 36 do not have to align with the air vents 34 in the mandrel 28. This air circulation conduit 42 takes the form of a groove formed in the inner face of the second bearing sleeve 26, about its entire circumference, and substantially aligned axially with the plane of the mandrel air vents 34.

The cylinder 22 of the bridge mandrel 20, over which the printing sleeve 30 is placed, has a hollow interior, and can be machined from steel or any other sufficiently rigid material capable of maintaining concentricity and may be plated with a material such as chrome to provide corrosion resistance and friction reduction. The exterior diameter of the cylinder 22 is slightly larger than the interior diameter of the unexpanded printing sleeve 30 to allow a tight friction fit between the two parts. While other means of connecting the bearing sleeves 24 and 26 to the cylinder 22 may be used, in the preferred embodiment, the cylinder 22 has threaded bolt holes 44 for receiving bolts 45 used to attach the first and second bearing sleeves 24 and 26 to the cylinder 22. As previously described, the cylinder 22 has one or more cylinder air passageways 38 and cylinder air vents 40 to allow compressed air to flow from the first mandrel 28, through the second bearing sleeve 26, and through the cylinder 22 to expand the printing sleeve 30 for installation and removal.

In the embodiment of the bridge mandrel 20 for use as an inking roller 12, the bridge mandrel 20 need not have the air passageways that are necessary for operation as a printing roller 10. However, the bridge mandrel 20 may be used as an inking roller 12 with the air passageways as part of the bridge mandrel's structure. When used as an inking roller 12, the cylinder 22 of the bridge mandrel 20 is coated with a ceramic material using a plasma coating process. The coating is then laser engraved with microfine ink-holding cells. Other materials may be used to coat the inking roller 12 and other methods may be used to create the microfine cells so long as the bridge mandrel 20 can effectively transfer ink to the printing roller 10.

In the preferred embodiment, the first and second bearing sleeves 24 and 26 are machined from fiberglass and have a lubricated inner surface, for instance impregnated with a fluorocarbon polymer, such as the fluorocarbon polymer sold under the trademark Teflon®, to allow ease of installation. Other comparable materials capable of maintaining concentricity and facilitating installation may also be used. Both bearing sleeves slide over the first mandrel 28 during installation of the bridge mandrel 20. The first bearing sleeve 24 has a notched portion 25 that engages an existing pin 21 on the first mandrel 28 to properly align the bridge mandrel 20 for printing and to transfer the rotation from the first mandrel 28 to the bridge mandrel 20. While other means of connecting the bearing sleeves 24 and 26 to the cylinder 22 may be used, in the preferred embodiment, the bearing sleeves have bolt holes with head countersink holes 46 for receiving the bolts 45 used to attach the bearing sleeves to the cylinder 22. As previously described, in the preferred embodiment of the bridge mandrel 20 for use as a printing roller 10, the second bearing sleeve 26 has an air circulation conduit 42 so that the second bearing sleeve air passageways 36 do not have to align with the air vents 34 in the first mandrel 28.

The bridge mandrel 20 is held in place with respect to the first mandrel 28 by a lock collar 48 as shown in FIGS. 1 and 3. The lock collar 48 may be comprised of two c-shaped sections held together by two bolts placed through tabs extending from the c-shaped sections, or other structure capable of holding the bridge mandrel 20 in place against the pin 21 and capable of preventing the bridge mandrel from moving longitudinally along the first mandrel 28.

The process of changing the printing roller 10 in a flexographic printing press from a standard integrated sleeve roller to the printing roller 10 in accordance with the present invention is a simple and expedient process that can usually be completed by a single operator. To remove the existing integrated sleeve roller, the press operator turns on the compressed air that is then forced through the air conduit 32 in the first mandrel 28 and out the air vents 34. The pressurized air causes the integrated sleeve roller on the first mandrel 28 to expand, such that it can easily slide off the mandrel. Then, the operator turns off the compressed air and slides the assembled bridge mandrel 20, the first bearing sleeve 24 going on first, over the first mandrel 28 such that the notched portion 25 of the first bearing sleeve 24 engages the pin 21 on the first mandrel 28. The operator then locks the bridge mandrel 20 in place on the first mandrel 28 using the lock collar 48. After the bridge mandrel 20 is locked in place, the compressed air is turned on and flows through the previously described network of passageways, exiting the cylinder 22 of the bridge mandrel 20 through the cylinder air vents 40. The printing sleeve 30 with flexographic printing plate 50 attached, expanded because of the air pressure, is then slid over the cylinder 22. After positioning the printing sleeve 30 in the proper location, the operator turns off the compressed air to allow the expanded printing sleeve 30 to return to its normal shape and create a non-slip friction fit over the bridge mandrel 20.

As with the printing roller conversion process, the process of changing the inking roller 12 in a flexographic printing press from a standard sleeve-type inking roller to the inking roller 12 in accordance with the present invention is a simple and expedient process that can usually be completed by a single operator. To remove the existing sleeve-type inking roller, the press operator turns on compressed air that is forced through the air conduit 32 in the first mandrel 28 and out the air vents 34. The pressurized air causes the sleeve-type inking roller on the first mandrel 28 to expand, such that it can easily slide off the mandrel. Then, the operator turns off the compressed air and slides the assembled bridge mandrel 20, the first bearing sleeve 24 going on first, over the first mandrel 28 such that the notched portion 25 of the first bearing sleeve 24 engages the pin 21 on the first mandrel 28. The operator then locks the bridge mandrel 20 place on the first mandrel 28 using the lock collar 48. No additional steps are necessary as the bridge mandrel 20 in accordance with the present invention has microfine cells capable of providing ink to the printing roller 10 engraved in a ceramic coating on the surface of the mandrel.

The first mandrel 28 is shown in FIG. 3 as an integrated, unitary piece but may be comprised of multiple parts. In the preferred embodiment of the present invention, cylinder 22 may be machined in a variety of exterior diameters to allow the printing of jobs having different repeat lengths. To reduce costs, the same bearing sleeves 24 and 26 may be used with cylinders 22 of different diameters.

As illustrated by the foregoing description and shown in the Figures, the present invention is more suitable as a printing roller and as an inking roller for flexographic printing presses than are existing roller systems. The present invention overcomes the limitations and disadvantages of existing roller systems by utilizing an effective roller design that is easily changed by a single operator, provides a high quality print because of its ability to maintain concentricity, and has a low cost.

Although the invention has been herein shown and described in what is perceived to be the most practical and preferred embodiment, it is to be understood that the invention is not intended to be limited to the specific embodiments set forth above. Rather, it is recognized that modifications may be made by one of skill in the art of the invention without departing from the spirit or intent of the invention and therefore, the invention is to be taken as including all reasonable equivalents to the subject matter of the appended claims.

We claim:

1. A roller for use in flexographic printing presses comprising:

a first mandrel mountable to a flexographic printing press;

a bridge mandrel removably mounted to and encircling said first mandrel; said bridge mandrel having a cylinder having a first and a second end, a first bearing sleeve detachably connected to said first end of said cylinder and mountable to said first mandrel, and a second bearing sleeve detachably connected to said second end of said cylinder and mountable to said first mandrel; and a printing sleeve removably mounted to and encircling said bridge mandrel.

2. The roller for use in flexographic printing presses of claim 1 wherein said first bearing sleeve is in rotational engagement with said first mandrel.

3. The roller for use in flexographic printing presses of claim 1 wherein said roller further comprises a compressed air conduit system running through said first mandrel and said bridge mandrel.

4. The roller for use in flexographic printing presses of claim 1 further comprising:

a mandrel air passageway through said first mandrel terminating in at least one mandrel air vent, said mandrel air passageway capable of conveying compressed air;

a bearing sleeve air passageway through said second bearing sleeve capable of receiving said compressed air from said mandrel air vent;

a cylinder air passageway through said cylinder terminating in at least one cylinder air vent, wherein said cylinder air passageway is capable of conveying said compressed air from said bearing sleeve air passageway to said at least one cylinder air vent.

5. The roller for use in flexographic printing presses of claim 4 wherein said bearing sleeve air passageway further comprises an air circulation conduit encircling said mandrel and in longitudinal alignment with said at least one mandrel air vent.

6. The roller for use in flexographic printing presses of claim 1 wherein said cylinder is machined from steel.

7. The roller for use in flexographic printing presses of claim 1 wherein said first bearing sleeve and said second bearing sleeve are constructed primarily from a fiberglass material.

8. The roller for use in flexographic printing presses of claim 1 wherein said cylinder is coated with a ceramic coating; said ceramic coating having a plurality of microfine cells.

9. A roller for use in a flexographic printing press comprising:

a first mandrel mountable to the flexographic printing press and having an air conduit;

a bridge mandrel removably mounted to and encircling said first mandrel, said bridge mandrel including a cylinder having a first and second end, a first bearing sleeve detachably connected to said first end of said cylinder and mountable to said first mandrel, and a second bearing sleeve detachably connected to said second end of said cylinder and mountable to said second mandrel;

an air passageway system in said bridge mandrel, said air passageway system in air transmission relation to said air conduit in said mandrel and having at least one air vent; and a printing sleeve removably mounted to and encircling said bridge mandrel.

10. The roller of claim 9 wherein said air passageway system comprises:

a mandrel air passageway through said first mandrel terminating in at least one mandrel air vent, said mandrel air passageway capable of conveying compressed air;

a bearing sleeve air passageway through said second bearing sleeve capable of receiving said compressed air from said air conduit;

a cylinder air passageway through said cylinder terminating in at least one cylinder air vent, wherein said cylinder air passageway is capable of conveying said compressed air from said bearing sleeve air passageway to said at least one cylinder air vent.

11. The roller of claim 10 wherein said bearing sleeve air passageway further comprises an air circulation conduit encircling said mandrel and in longitudinal alignment with said at least one mandrel air vent.

12. The roller of claim 11 wherein said cylinder is machined from steel.

13. The roller of claim 11 wherein said first bearing sleeve and said second bearing sleeve are constructed primarily from fiberglass.

14. The roller of claim 11 wherein said cylinder is coated with a ceramic coating; said ceramic coating having a plurality of microfine cells.

15. A bridge mandrel for use in conjunction with a first mandrel, cover sleeve, and flexographic printing plate as the printing roller in flexographic printing presses comprising:

a cylinder having a first and a second end;

a first bearing sleeve detachably connected to said first end of said cylinder and mountable to said first mandrel;

a second bearing sleeve detachably connected to said second end of said cylinder and mountable to said first mandrel;

a mandrel air passageway through said first mandrel terminating in at least one mandrel air vent, said mandrel air passageway capable of conveying compressed air;

a bearing sleeve air passageway through said second bearing sleeve, said bearing sleeve air passageway capable of receiving said compressed air from said mandrel air vent; and a cylinder air passageway through said cylinder terminating in at least one cylinder air vent, wherein said cylinder air passageway is capable of conveying said compressed air from said bearing sleeve passageway to said at least one cylinder air vent.

16. The bridge mandrel of claim 15 wherein said bearing sleeve air passageway further comprises an air circulation conduit encircling said mandrel and in longitudinal alignment with said at least one mandrel air vent.

* * * * *